US006886500B2

(12) United States Patent
Manini

(10) Patent No.: US 6,886,500 B2
(45) Date of Patent: May 3, 2005

(54) GAS FED WATER-HEATER

(75) Inventor: Paolo Manini, Arluno (IT)

(73) Assignee: Saes Getters S.p.A., Lainate (IT)

( * ) Notice: Subject to any disclaimer, the term of this patent is extended or adjusted under 35 U.S.C. 154(b) by 0 days.

(21) Appl. No.: 10/909,889

(22) Filed: Aug. 2, 2004

(65) Prior Publication Data

US 2005/0000471 A1 Jan. 6, 2005

Related U.S. Application Data

(63) Continuation of application No. PCT/IT03/00350, filed on Jun. 4, 2003.

(30) Foreign Application Priority Data

Jun. 7, 2002 (IT) ..... MI2002A1244

(51) Int. Cl.[7] ..... B65D 90/06
(52) U.S. Cl. ..... 122/19.2; 122/494; 220/694.1
(58) Field of Search ..... 122/19.2, 494; 126/344; 220/694.1, 567.3

(56) References Cited

U.S. PATENT DOCUMENTS 2,544,927 A 3/1951 Knapp
3,360,895 A * 1/1968 Green ..... 52/249
5,509,566 A * 4/1996 Nelson ..... 220/592.25
6,588,378 B1 * 7/2003 Henderson et al. ..... 122/19.2
6,807,925 B1 * 10/2004 Lesage ..... 122/14.1

FOREIGN PATENT DOCUMENTS

DE 195 35 265 C1 10/1996
WO WO 00/75557 A1 12/2000

* cited by examiner

*Primary Examiner*—Gregory Wilson
(74) *Attorney, Agent, or Firm*—Akin Gump Strauss Hauer & Feld, LLP

(57) ABSTRACT

The present invention relates to a gas fed water-heater comprising a double wall container (1) inside which a burner (2) and a tank (3) of the water to be heated are arranged. At least in the portion (5') adjacent to the burner (2) of the interspace (5) between the two walls of said container (1) is placed a thermoinsulating system comprising an inner layer (6) of glass wool or rock wool and an outer layer (7) formed of at least a one vacuum panel, which comprises an envelope which encloses inert material powder with an average size of the particles lower than 100 nanometers.

10 Claims, 1 Drawing Sheet

GAS FED WATER-HEATER

This application is a continuation of PCT/IT03/00350, dated Jun. 4, 2003.

The present invention relates to a gas fed water-heater, particularly to a gas fed water-heater provided with a thermoinsulating system placed around the area of the burner to avoid heat losses.

It is known that water-heaters, usually referred to as "heaters", can be fed by gas or electricity. The gas fed water-heaters of accumulation type comprise a generally cylindrical or parallelepiped container in which a gas burner and a tank containing the water to be heated are placed. The burner generally occupies the lower part of the container and is connected above to a heat exchanger traversing the tank, thus heating the water contained therein.

Said container is generally formed of a double wall and in the interspace enclosed therein an insulating material is arranged, necessary to avoid heat losses which obviously would lower the energetic yield of the water-heater. Particularly, in the portion of the interspace adjacent to the tank is usually inserted a polymeric insulator, for example a polyurethanic foam, while in the portion adjacent to the position of the burner, glass wool or rock wool is used as insulating material.

However, this type of insulation has the drawback that to ensure a good thermal tightness in the burner area, which has a very high temperature (being capable of reaching 250–300° C.), it is necessary to use a very thick layer of rock wool, thus increasing the total encumberance of the water-heater or decreasing the capacity.

The object of the present invention is therefore to provide a water-heater provided with a thermoinsulating system capable of efficiently avoiding the threat loss, without increasing the volume of the insulator with respect to the systems utilized up to now. Said object is achieved with a water-heater whose main features are specified in the first claim and other features are specified in the subsequent claims.

It has been found that, by placing a two layers thermoinsulating system according to the invention at least in the portion of the interspace of a water-heater which is adjacent to the burner, it is possible to improve the insulation of the same water-heater, thus obtaining a power saving of about 10%

Particularly, the best energetic yield of the water-heater is achieved when said inner layer based on rock wool or glass wool occupies about 70–80% of the volume available for the thermoinsulating system, the remainder volume being occupied by said vacuum panel.

Figure 1:
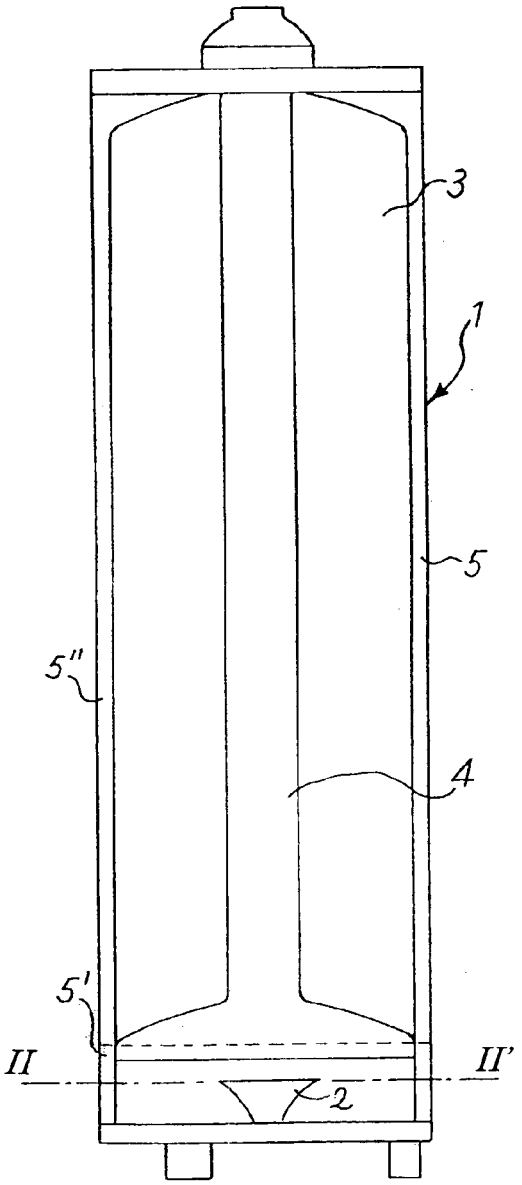
Figure 2:
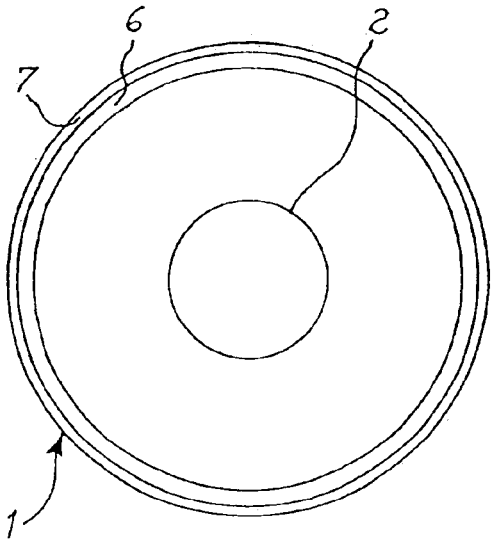

The advantages and the features of the water-heater according to the present invention will be clear to those skilled in the art from the following detailed description of one embodiment thereof with reference to the attached drawings wherein:

FIG. 1 shows a longitudinal section view of a water-heater according to this embodiment; and FIG. 2 shows a cross sectional view of the water-heater along line I–I' of FIG. 1.

Referring to FIG. 1, it is shown that the gas water-heater according to the present invention comprises in a known way a double wall container 1, cylindrically shaped, inside which a burner 2 and, thereover, a tank 3 of the water to be heated are placed. Burner 2 is upperly connected to a heat exchanger 4 crossing said tank 3 thus heating the water contained therein. The double wall defines an interspace, 5, which lower portion 5' is adjacent to the area occupied by the burner, while the upper portion 5" is adjacent to the area of the tank; the dotted line of the drawing represents the separation between of the two portions 5' and 5".

FIG. 2 represents a cross section of the water-heater perpendicular to the axis thereof, to the height of portion 5'. As it is shown in FIG. 2, in the lower area of the interspace is inserted a thermoinsulating system comprising at least two different layers, that is, an inner layer 6, nearer to burner 2, formed of rock wool or glass wool, and an outer layer 7 formed of at least a vacuum thermoinsulating panel.

The panel, comprising plastic materials, could not be placed in direct contact with the wall delimiting the burner, which reaches temperatures higher than 250° C. Layer 6 has however thermal insulating properties, so that the surface of this layer opposed to the one in contact with the burner is at a lower temperature, that the panel can withstand. In turn, the panel wrapped around layer 6 has higher thermal insulation properties than a layer of glass wool or rock wool, of same thickness of the panel, would have. By wrapping the panel around layer 6, thus, it is obtained a synergic effect, with the inner layer protecting the panel from thermal deterioration, and the panel notably increasing the thermal insulation of the system at the same overall thickness.

The two layers thermoinsulating system could be present even in the portion 5" of the interspace; however since temperatures in this area are lower and do not require insulation of very high efficiency, it is preferable (even for economic reasons) to fill said portion 5" with any known thermoinsulating material, for example a foamed polymeric material. The separation between the portions 5' and 5" of the interspace may be only geometric, or obtained through a separation element.

As it is known, a vacuum thermoinsulating panel is made up of an envelope wherein a filling material is present under vacuum. The envelope has the function of preventing (or reducing as much as possible) the inlet of atmospheric gases inside the panel, so as to keep vacuum level compatible with the thermoinsulating level required from the application, and is made with so-called "barrier" sheets, characterized by a gas permeability being as low as possible. The filling material has the main function of spacing apart the two opposite faces of the envelope when vacuum is created in the panel, and must have a porous or discontinue internal structure so that the porosities or interstices thereof can be evacuated so as to perform the thermoinsulating duty.

The vacuum panel in the water-heater according to the present invention comprises, as filling material, an intent material powder having an average size of the particles lower than 100 nanometers, and preferably comprised between 2 and 20 nanometers. As it is known, the thermoinsulating properties of this type of panels vary only slightly as a function of their internal pressure, which can reach some tens of millibar without compromising these properties. For this reasons, the envelope of these panels can advantageously be made up of a plastic material, for example polyolefinic, possibly metallized.

According to a preferred embodiment of the invention, the inert material of the powder is silica preferably mixed with mineral fibers, such as glass fibers, so as to be easily compressed to form boards thick up to some millimeters, which can be bent relatively easily.

The silica used for the invention can be for example precipitated silica, manufactured for example by the German company Degussa GmbH. Preferably, pyrogenic silica is used, a form of silica obtained by burning $SiCl_4$ with oxygen in a suitable chamber, manufactured and sold for example by the US company CABOT Corp, under the name Nanogel® or by the German company Wacker GmbH.

Possible changes and/or additions may be made by those skilled in the art to the embodiment of the invention here described and illustrated without departing from the scope the same invention.

I claim:

1. A gas fed water-heater comprising a double wall container (1) inside of which are arranged a burner (2) and a tank (3) for water to be heated, the double wall defining an interspace (5) containing a thermoinsulating system, wherein the thermoinsulating system comprises, at least in a first portion (5') of the interspace adjacent to the burner, an inner layer (6) of rock wool or glass wool and an outer layer (7) formed of at least one vacuum panel comprising an envelope which encloses an inert material powder having an average particle size of less than 100 nanometers.

2. The water-heater according to claim 1, wherein the inner layer (6) has a volume percentage comprising between 70–80% of the total volume of the thermoinsulating system.

3. The water-heater according to claim 1, wherein the inner layer of rock wool or glass wool and the at least one vacuum panel of the thermoinsulating system occupy only the first portion (5') of the interspace adjacent to the burner (2).

4. The water-heater according to claim 3, wherein a second portion (5")of the interspace adjacent to the tank (3) is filled with a foamed polymeric material.

5. The water-heater according to claim 1, wherein the inert material powder comprises particles with an average size between 2 and 20 nanometers.

6. The water-heater according to claim 1, wherein the envelope comprises a plastic material.

7. The water-heater according to claim 6, wherein the plastic material is metallized.

8. The water-heater according to claim 1, wherein the inert material powder is mixed with mineral fibers.

9. The water-heater according to claim 8, wherein the mineral fibers comprise glass fibers.

10. The water-heater according to claim 1, wherein the inert material comprises pyrogenic silica.

* * * * *